US009151053B2

(12) United States Patent
Stephens, Jr. et al.

(10) Patent No.: US 9,151,053 B2
(45) Date of Patent: Oct. 6, 2015

(54) MODULAR BUILDING PANEL WITH FRAME

(71) Applicant: Build Green Structures, LLC, Austin, TX (US)

(72) Inventors: Roy Dean Stephens, Jr., Lockhart, TX (US); James Michael Qualls, Austin, TX (US)

(73) Assignee: Sustainable Holdings, Inc., New Orleans, LA (US)

( * ) Notice: Subject to any disclaimer, the term of this patent is extended or adjusted under 35 U.S.C. 154(b) by 0 days.

(21) Appl. No.: 13/926,426

(22) Filed: Jun. 25, 2013

(65) Prior Publication Data

US 2014/0033627 A1 Feb. 6, 2014

Related U.S. Application Data

(60) Provisional application No. 61/664,567, filed on Jun. 26, 2012.

(51) Int. Cl.

| | |
|---|---|
| ***E04C 2/52*** | (2006.01) |
| ***E04C 2/20*** | (2006.01) |
| ***E04C 2/38*** | (2006.01) |
| ***E04C 2/02*** | (2006.01) |
| ***E04B 2/02*** | (2006.01) |
| ***E04C 2/22*** | (2006.01) |

(52) U.S. Cl.

CPC ... *E04C 2/52* (2013.01); *E04B 2/02* (2013.01); *E04C 2/205* (2013.01); *E04C 2/22* (2013.01); *E04C 2/38* (2013.01); *E04C 2/384* (2013.01); *E04C 2/521* (2013.01)

(58) Field of Classification Search

CPC ..... E04C 2/52; E04C 2/22; E04C 2/521; E04C 2/384; E04C 2/205; E04C 2/38; E04B 2/02

USPC ..... 52/204.5, 220.1, 220.8, 309.1, 309.16, 52/481.1, 792.1, 792.11, 793.1, 794.1

See application file for complete search history.

(56) References Cited

U.S. PATENT DOCUMENTS

| | | | | | |
|---|---|---|---|---|---|
| 3,353,315 | A | * | 11/1967 | Barker | 52/275 |
| 4,223,500 | A | * | 9/1980 | Clark et al. | 52/309.4 |
| 4,354,810 | A | * | 10/1982 | Stidham | 425/91 |
| 4,551,958 | A | * | 11/1985 | Reneault et al. | 52/309.4 |
| 4,641,469 | A | | 2/1987 | Wood | |
| 4,953,334 | A | * | 9/1990 | Dickens | 52/309.4 |
| 5,265,389 | A | * | 11/1993 | Mazzone et al. | 52/309.7 |
| 5,414,972 | A | * | 5/1995 | Ruiz et al. | 52/600 |
| 5,722,198 | A | * | 3/1998 | Bader | 52/745.09 |

(Continued)

OTHER PUBLICATIONS

"Understanding the Art of Ultra Frame Structural Insulated Panels", Transcon Steel, May 8, 2011, pp. 1-7.

(Continued)

*Primary Examiner* — Rodney Mintz

(74) *Attorney, Agent, or Firm* — Meyertons, Hood, Kivlin, Kowert & Goetzel, P.C.; Eric B. Meyertons

(57) ABSTRACT

A building panel includes a polymeric block, one or more framing studs and one or more framing studs at least partially embedded in or to the polymeric block. The block includes a panel interior surface and a panel exterior surface. The panel interior surface of the polymeric block is offset from at least one of the one or more framing studs. The panel interior surface of the polymeric block includes one or more slots that can receive framing studs.

20 Claims, 14 Drawing Sheets

(56) References Cited

U.S. PATENT DOCUMENTS

| | | | | |
|---|---|---|---|---|
| 5,787,665 | A * | 8/1998 | Carlin et al. | 52/309.4 |
| 5,799,462 | A * | 9/1998 | McKinney | 52/742.13 |
| 5,822,940 | A * | 10/1998 | Carlin et al. | 52/479 |
| 5,842,276 | A * | 12/1998 | Asher et al. | 29/897.32 |
| 5,893,248 | A * | 4/1999 | Beliveau | 52/309.7 |
| 5,943,775 | A * | 8/1999 | Lanahan et al. | 29/897.32 |
| 6,044,603 | A * | 4/2000 | Bader | 52/309.7 |
| 6,167,624 | B1 | 1/2001 | Lanahan et al. | |
| 6,263,628 | B1 * | 7/2001 | Griffin | 52/309.12 |
| 6,385,942 | B1 * | 5/2002 | Grossman et al. | 52/798.1 |
| 6,796,093 | B2 * | 9/2004 | Brandes | 52/309.8 |
| 7,162,847 | B2 | 1/2007 | Gigiakos | |
| 7,543,419 | B2 | 6/2009 | Rue | |
| 8,109,058 | B2 | 2/2012 | Miller | |
| 8,136,248 | B2 * | 3/2012 | Beavers et al. | 29/897.3 |
| 8,234,833 | B2 | 8/2012 | Miller | |
| 8,359,808 | B2 * | 1/2013 | Stephens, Jr. | 52/742.14 |
| 8,561,371 | B2 * | 10/2013 | Sanders et al. | 52/764 |
| 8,726,594 | B2 * | 5/2014 | Salazar et al. | 52/309.16 |
| 8,978,325 | B2 * | 3/2015 | Lewis | 52/220.2 |
| 2003/0029112 | A1 * | 2/2003 | Wise | 52/439 |
| 2005/0204697 | A1 | 9/2005 | Rue | |
| 2005/0284100 | A1 * | 12/2005 | Ashuah et al. | 52/794.1 |
| 2006/0117689 | A1 * | 6/2006 | Onken et al. | 52/309.7 |
| 2006/0191232 | A1 * | 8/2006 | Salazar et al. | 52/606 |
| 2007/0227086 | A1 * | 10/2007 | Beavers et al. | 52/309.7 |
| 2010/0011701 | A1 | 1/2010 | Cole et al. | |
| 2010/0095621 | A1 * | 4/2010 | Pumper et al. | 52/404.4 |
| 2010/0107539 | A1 * | 5/2010 | Martens et al. | 52/506.05 |
| 2010/0236163 | A1 * | 9/2010 | Sanders et al. | 52/145 |
| 2010/0236173 | A1 * | 9/2010 | Pacha et al. | 52/309.11 |
| 2010/0300012 | A1 * | 12/2010 | Beavers et al. | 52/79.1 |
| 2011/0113707 | A1 * | 5/2011 | Stephens, Jr. | 52/220.2 |
| 2011/0239573 | A1 * | 10/2011 | Lockhart | 52/404.1 |
| 2012/0131870 | A1 * | 5/2012 | deMaere | 52/309.4 |
| 2012/0167507 | A1 * | 7/2012 | Beavers et al. | 52/309.1 |
| 2012/0216476 | A1 * | 8/2012 | Naidoo | 52/309.4 |
| 2012/0247043 | A1 * | 10/2012 | McDonald et al. | 52/309.7 |
| 2012/0291384 | A1 * | 11/2012 | Martens | 52/309.1 |
| 2013/0067838 | A1 * | 3/2013 | Black et al. | 52/220.7 |
| 2013/0104480 | A1 * | 5/2013 | Smith | 52/309.7 |
| 2013/0133277 | A1 * | 5/2013 | Lewis | 52/220.1 |
| 2014/0059959 | A1 * | 3/2014 | Salazar et al. | 52/309.13 |
| 2014/0069040 | A1 * | 3/2014 | Gibson | 52/506.01 |
| 2014/0115988 | A1 * | 5/2014 | Sievers et al. | 52/302.1 |
| 2014/0115989 | A1 * | 5/2014 | Sievers et al. | 52/302.1 |
| 2014/0202097 | A1 * | 7/2014 | Rodgers | 52/309.6 |
| 2014/0215947 | A1 * | 8/2014 | Naidoo | 52/309.1 |
| 2014/0260031 | A1 * | 9/2014 | Salazar et al. | 52/309.16 |

OTHER PUBLICATIONS

"Stud Snuggler Wall Systems", Advanced Wall Systems, Mar. 29, 2012, pp. 1-3.
"StyroHome Review", Ergodesk, Aug. 27, 2008, pp. 1-11.
"What are SIPs?", Steel Sip Systems, Mar. 29, 2012, pp. 1-3.

* cited by examiner

MODULAR BUILDING PANEL WITH FRAME

PRIORITY CLAIM

This application claims priority to U.S. Provisional Application Ser. No. 61/664,567 entitled "MODULAR BUILDING PANEL WITH FRAME" filed Jun. 26, 2012, which is incorporated herein by reference in its entirety.

BACKGROUND

1. Field

The present invention relates generally to systems and methods of constructing buildings. More particularly, the present disclosure relates to systems and methods of using modular building panels with framed insulating blocks.

2. Description of the Related Art

For many years, a common manner of constructing residential structures involved constructing a wood frame. One of the problems with a wood framed house is that such a house may be relatively expensive to heat in the winter and hard to cool in the summer. As the cost of energy has continued to rise, this has been a continuing concern for the homeowners and, hence, a concern for home builders.

Foam may be used for insulation purposes in residential buildings. Sometimes expanded foam is sprayed inside the walls or under the roofs of residential buildings to provide additional insulation. In recent years, insulating concrete forms (referred to as "ICF") has been used in residential structures. Many different types of methods have evolved for building ICF residential buildings.

A problem with some foam systems is that much labor is required in the shaping, cutting or modifying the foam blocks for the particular structure. A second problem is that after cutting, shaping or modifying the foam structure, the foam structure loses much of its insulating value. Third, the insulating foam may not have good structural integrity, so concrete must be used to give the strength necessary for the structure.

Some insulating modular panels have been used for building. In some cases, the panels must be held in place by braces or other temporary structural members during the construction process. Supplying and implementing such temporary bracing systems adds labor and cost to the construction process.

Custom passages, notches or other features may be added to a foam panel when it is to be installed, for example, to run electrical cables or plumbing. In many cases, making such features may require cutting into structural members associated with the panel. For example, to make passage for a conduit in an insulating panel, it may be necessary to cut a hole or notch in a metal rail supporting the panel. Such cutting adds time and complexity to the planning and construction of the building.

SUMMARY

Embodiments of building panels, and methods and systems for making and using building panels, are described herein. In an embodiment, a building panel includes a polymeric block, one or more framing studs and one or more framing studs at least partially embedded in or to the polymeric block. The block includes a panel interior surface and a panel exterior surface. The panel interior surface of the polymeric block is offset from at least one of the one or more framing studs. The panel interior surface of the polymeric block includes one or more slots that can receive framing studs.

In an embodiment, a building panel includes one or more polymeric blocks, one or more framing studs at least partially embedded in or to at least one of the one or more polymeric blocks, and one or more surface-mounted framing studs mounted on at least one exterior surface of the polymeric block. The orientation of at least one of the surface-mounted framing studs is different from than orientation of at least one of the one or more embedded framing studs.

In an embodiment, a method of making a building panel including positioning at least a portion of one or more frame members in a loose polymer material. A solid block is formed from the loose polymer material. At least a portion of the frames is embedded in the solid block.

In an embodiment, a building includes two or more building panels coupled to one another. The building panels may include a polymeric block and one or more framing studs at least partially embedded in or to the polymeric block. The panel interior surface of the polymeric block is offset from the framing studs.

In an embodiment, a method of constructing a building includes providing two or more building panels having a frame and polymeric block. The polymeric block of the building panes includes a framed portion and an offset portion. The panels are positioned such that the offset portion extends toward the interior of the building. The building panels are connected to one another.

While the invention is described herein by way of example for several embodiments and illustrative drawings, those skilled in the art will recognize that the invention is not limited to the embodiments or drawings described. It should be understood, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

As used herein, a "polymeric material" means a material that is made at least primarily of one or more polymers. As used herein, a "polymer" means a naturally occurring or synthetic compound consisting of large molecules made up of a linked series of repeated simple monomers. Examples of polymers include polyolefins (such as polyethylene and polypropylene), polyurethanes, polyvinylchloride, polyesters, poly ethylene vinyl alcohol, polyvinyl alcohol, polycaprolactone, polylactic acid and foamed starch. A polymeric material may be expanded foam, such as expanded polystyrene. In some embodiments, a polymeric material is fire retardant.

As used herein, "polymeric block" means a block that is at least primarily made of a polymeric material.

As used herein, to be "embedded" in or to another element or elements means at least partially contained within, or at least partially surrounded by, the element or elements. As one example, a framing stud is embedded in a polymeric block if the framing stud is inserted, pressed, or dropped into a pre-cut slot or channel in the block. As another example, a framing stud may be embedded by expanding a loose foam material around the framing stud. In certain embodiments, there may be clearance between the surfaces (for example, a gap between the surfaces of a framing stud and the adjacent surfaces of a polymeric block).

As used herein, "frame member" means a member that can be coupled with one or more other members to form a frame.

As used herein, "framing stud", or "stud", means a primarily vertical member that can bear a downward load.

As used herein, a "c-shaped" cross section refers to a cross section that is generally in the form of a C. As used herein, a "u-shaped" cross section refers to a cross section that is generally in the form of a U. A c-shaped member or a u-shaped member may include variations such as bumps, bulges, ridges, corrugations, lips, rounded corners, sharp corners, tapers.

Figure 1:
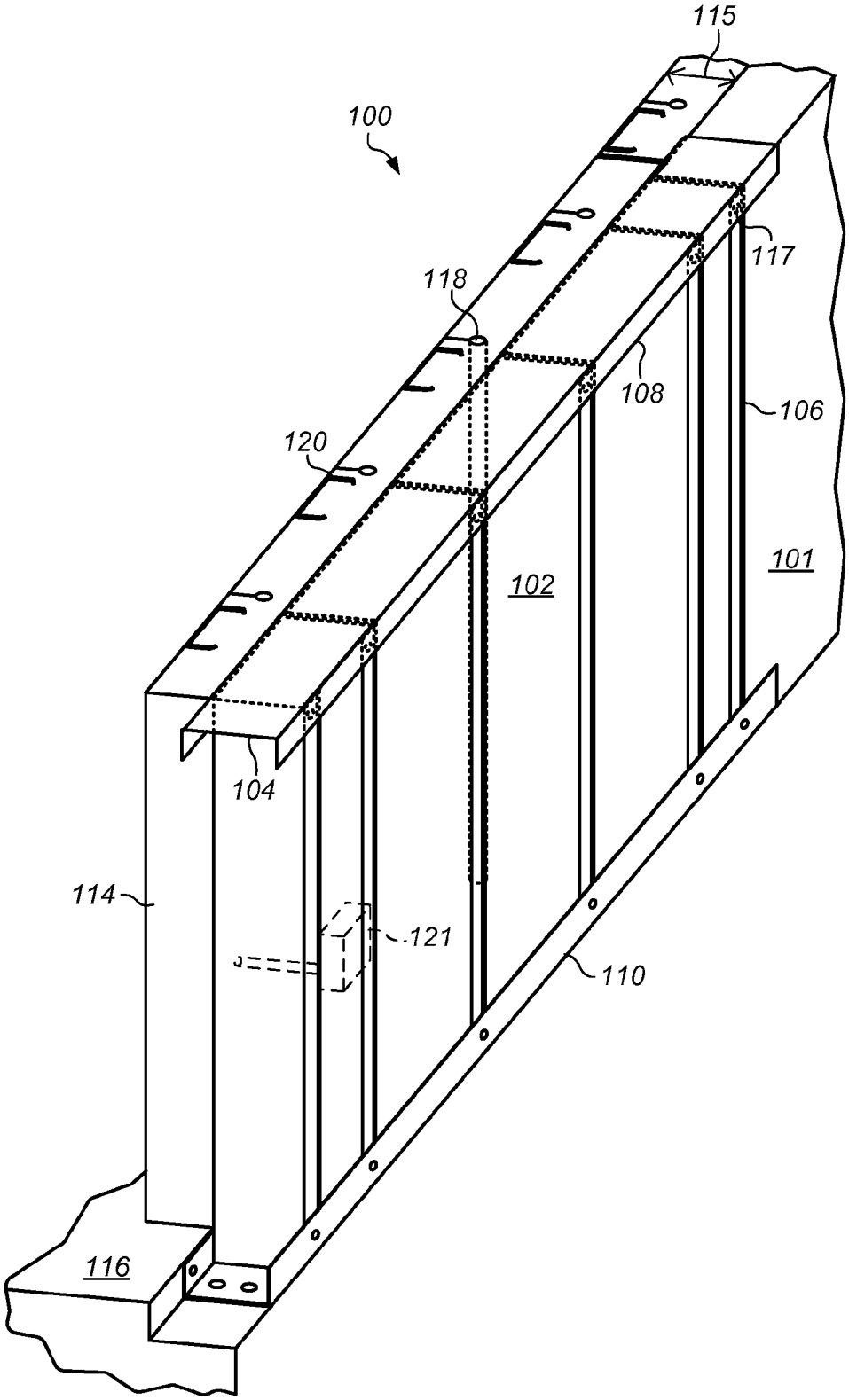
FIG. 1 illustrates one embodiment of one embodiment of a building panel.

FIG. 1 illustrates one embodiment of a building panel. Building panels may be used, for example, as elements of a wall, floor, ceiling, or roof of a building. Building panel 100 includes block 102 and frame 104. Frame 104 includes main studs 106, top cross rail 108, and bottom cross rail 110. Block 102 includes main body 112 and offset 114. Building panel 100 is installed on slab 116. Building panel 100 may be coupled to adjacent building panel 101. Main studs 106 may extend in a vertical direction through block 102.

Offset 114 may extend from the framed portion of block 102 toward the interior portion of a building relative to frame 104. In FIG. 1, the thickness of the offset is shown as dimension 115. In one embodiment, frame members are about 3 and ⅝ inches up to about 7 and ⅝ inches in thickness, and the thickness of offset 114 is about 4 and ⅜ inches up to about 8 and ⅜ inches.

Interior surface studs 120 are mounted on the interior surface of offset 114. In the embodiment illustrated in FIG. 1, interior surface studs 120 are installed such that both interior surface studs 120 and main studs 106 run vertically and are parallel to each other. With respect to the cross section of the studs, however, interior surface studs 120 may be installed in a different orientation than main studs 106. In this case, interior surface studs 120 are installed such that the cross section of interior surface studs 120 is perpendicular to the cross section of main studs 106. In certain embodiments, different studs may run in different directions that one another. For example, one or more of studs in the frame of a building panel may be embedded in the building panel at a slant and others of studs in the frame of the building panel may run vertically. As another example, the surface-mounted studs for a building panel may be installed at a slant, and the studs in the frame of the building panel may run vertically.

In the embodiment shown in FIG. 1, the surface-mounted studs are at an orientation that is perpendicular to that of the main studs. A building panel may, nevertheless, in various embodiments include studs that are installed in other relative orientations to one another. For example, a stud in a building panel may be installed in an orientation that is 45 degrees relative to another stud in the building panel.

Block 102 may be made of a polymeric material. In some embodiments, block 102 is made of expanded polystyrene foam. Block 102 may be of an insulating material. In some embodiments, the density of a block is between about 1.5 and about 2.0 pounds per cubic foot.

In some embodiments, a block of a building panel includes passages or openings. For example, as shown in FIG. 1, block 102 includes cylindrical passages 118 and passages 121. Cylindrical passages 118 and passages 121 may be used for running conduit, electrical wires, plumbing, or other elements. A block for a building panel may also include openings for doors or windows. In some embodiments, a block includes notches, channels, or other features for receiving, connecting, or meshing with other building elements. In some embodiments, passages are provided at spaced intervals along the length of a panel. For example, a vertical chase may be provided in the offset portion of building panel 100 at 8 inch intervals along the length of the panel.

Frame members such as main studs 106, top cross rail 108, bottom cross rail 110, may be made of a metal, such as steel or aluminum. In one embodiment, main studs 106, top cross rail 108, bottom cross rail 110 are made of 24 gauge galvanized steel.

Main studs 106, top cross rail 108, and bottom cross rail 110 may combine to form frame 104. Top cross rail 108 may couple with main studs 106 at the top of block 102. Bottom cross rail 108 may couple with main studs 106 at the top of block 102. In one embodiment, top cross rail 108 and bottom cross rail 110 are coupled to the main studs by way threaded fasteners, such as bolts or machine screws. In certain embodiments, the cross rails for the panel may be connected to the main studs by way of rivets 117.

A building panel may be of any suitable dimensions. A building panel may be, for example, between 8 feet and 18 feet tall. In one embodiment, a building panel is about 9 feet tall. In another embodiment, a building panel is about 50 inches tall. Two or more panels may be stacked on one another. As shown in FIG. 1, the bottom portion of a building panel may have a notch corresponding to a step on the slab on which the panel is to be installed.

In some embodiments, different building panels may be produced with different offset thicknesses. In some embodiments, different building panels may have different densities from one another. In certain embodiments, an offset portion of a panel (for example, offset from a frame), has a different density than other portions of the panel.

In the embodiment illustrated in FIG. 1, the offset portion of block 110 is offset in an interior direction. A panel block may, nevertheless, in various embodiments include an offset in other directions. For example, a panel block may include an offset in an exterior direction.

In some embodiments, passages in a block for a panel are provided in a portion of the panel that is offset from frame members of the panel. For example, passages may be provided in offset 114 of building panel 100. In some cases, pipes, wiring, conduits or other elements may be routed in the passages without drilling or cutting in frame members for a panel.

Figure 2:
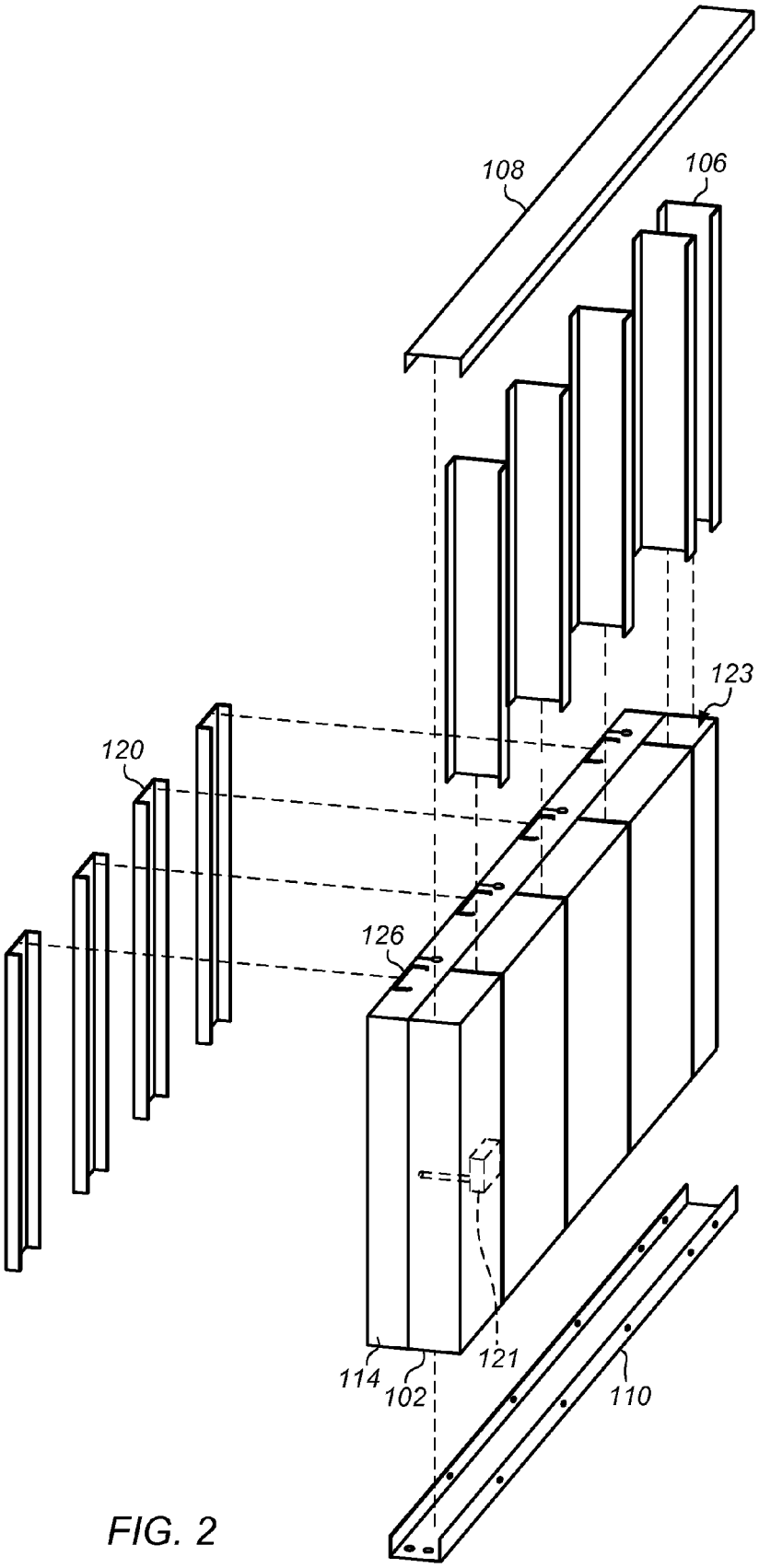
FIG. 2 illustrates an exploded view of one embodiment of a building panel.

FIG. 2 illustrates an exploded view of the building panel shown in FIG. 1. Main studs 106 may reside in main slots 123. Main studs 106 may be at least partially embedded in block 102. In some embodiments, main studs 106 are in place when block 102 is molded into a solid block. For example, main studs 106 may be held in position in loose polymeric material, such as beads or pellets, from which block 102 is made (for example, by way of a fixture).

Interior surface studs 120 may be installed in interior surface slots 126 in the offset portion of block 102. In some embodiments, each of studs 120 is inserted from the top (for example, through the top surface of offset 114). In some embodiments, cross members of frame, such as top cross rail 108, bottom cross rail 110, or both, may be positioned in a block when the block is molded. In certain embodiments, all of the frame members of a panel are in place during molding of a block.

Figure 3:
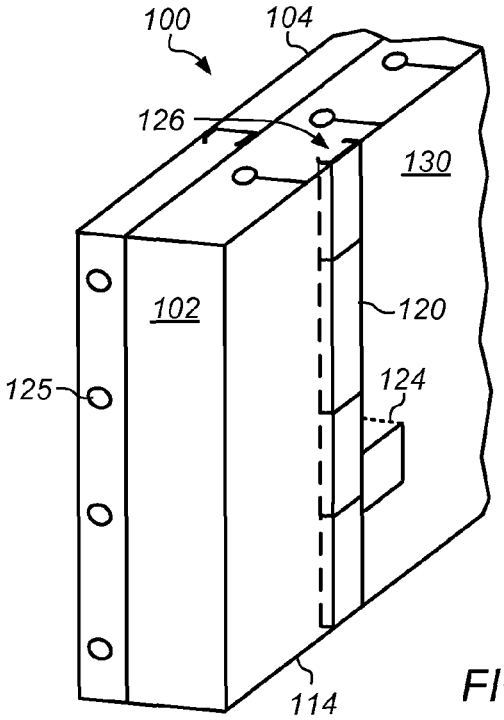
FIG. 3 illustrates an interior view of a building panel.

FIG. 3 illustrates an interior view of a building panel. Interior surface studs 120 are installed on interior surface 130 of block 102 in slots 126 in the interior offset portion of block 102. In some embodiments, interior surface studs are press-fit into interior surface slots 126. Interior surface studs 120 may be used for attaching additional building elements or decorative elements to building panels 100.

Interior surface studs 120 may run the full height of the offset portion. In some embodiments, two or more sections of studs are stacked within a particular slot. In this manner, relatively short lengths of studs (for example, scrap generated during construction of the building) can be used for the surface-mounted studs.

Block 102 includes junction box cavity 124. Junction box cavity 124 may be adjacent to a pair of slots 126 for interior surface studs 120. A junction box may be positioned in junction box cavity 124 and attached to interior surface studs 120.

Figure 4:
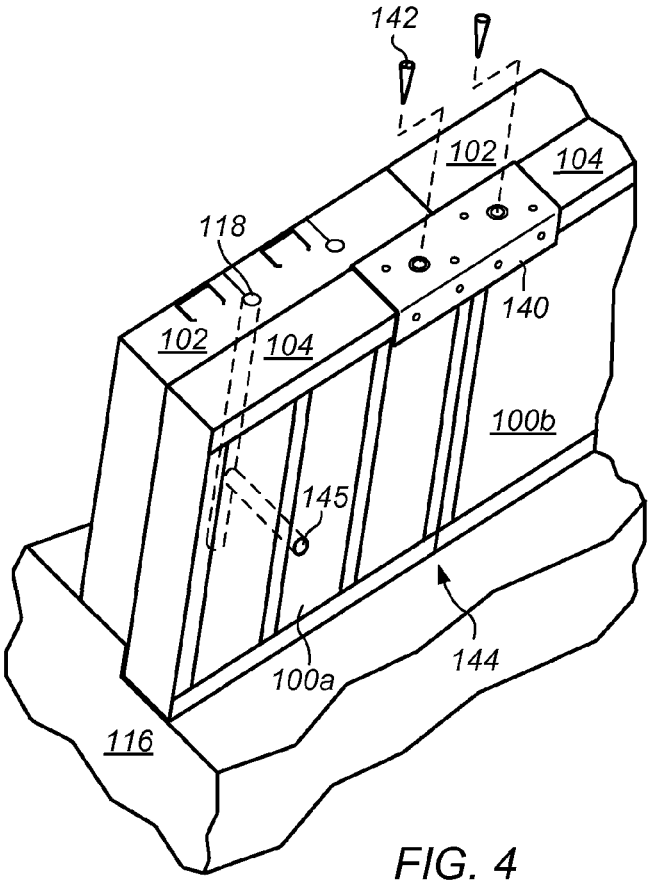
FIG. 4 illustrates one embodiment of a connection between building panels.

FIG. 4 illustrates one embodiment of a connection between building panels. Building panels 100*a* and 100*b* are connected with panel connector 140. Panel connector 140 bridges the top of frames 104 of building panels 100*a* and 100*b*. Panel connector 140 may connect building panels 100*a* and 100*b* at junction 144.

Pins 142 may pass through holes in panel connector 140 and engage in corresponding holes or sockets in frames 104, blocks 102, or both. In some embodiments, pins 142 temporarily hold building panels 100*a* and 100*b* together until a more permanent connection is established between the panels. For example, pins 142 may temporarily hold building panels 100*a* and 100*b* in place until building panels 100*a* and 100*b* are coupled to one another by way of an adhesive, or by way of threaded fasteners securing panel connector 140 to building panels 100*a* and 100*b*. Pins 142 may be made of any suitable material. In one embodiment, pins 142 are made of a polymer.

In some embodiments, passages may be provided between internal passages in a panel and the surfaces of the panel. For example, in FIG. 4, passage 145 may be drilled to create access between passage 118 and the exterior face of panel 100*a*. In some embodiments, surface studs and studs of a frame (for example, main studs 106) are generally aligned with one another along the length of a panel, such that any obstruction of passages (such as passage 145) is minimized.

Figure 5:
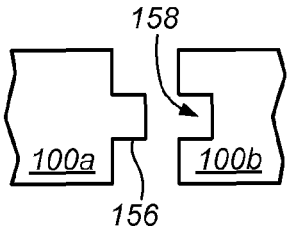
FIG. 5 is a schematic top view illustrating one embodiment of a tongue and groove connection between building panels.

In some embodiments, a tongue and groove connection is provided between adjacent building panels. Each building panel may have a tongue element on one side of the panel and a complementary groove element on the other side of the building panel. In this arrangement, an unlimited number of building panels may be connected, one after another. FIG. 5 is a schematic top view illustrating one embodiment of a tongue and groove connection between building panels. Building panel 100*a* includes tongue 156. Building panel 100*b* includes groove 158. In certain embodiments, a tongue and groove connection is provided between building panels that are located one above another.

In some embodiments, pins are used to align adjacent panels. For example, pins may be inserted in one or more of holes 125 in the side of panel 100 in FIG. 3 and a corresponding hole in the adjacent building panel.

Figure 6:
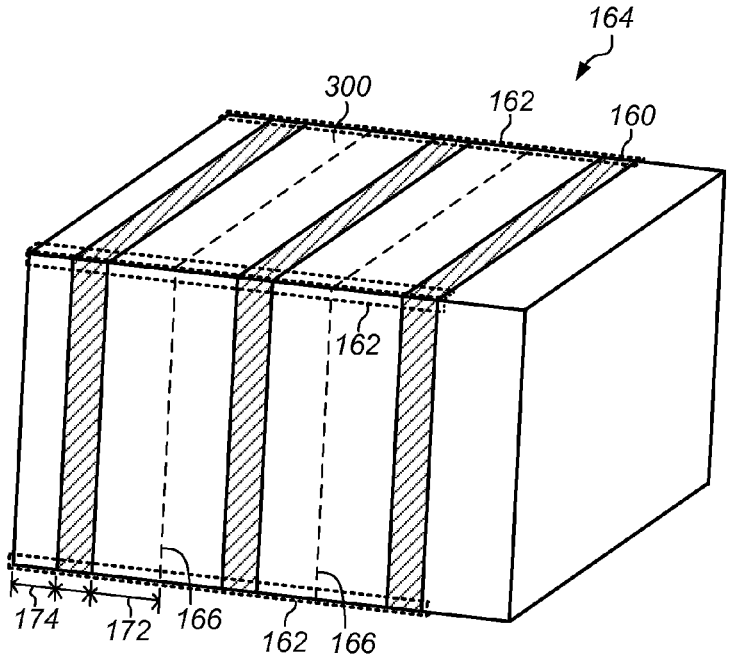
FIG. 6 illustrates a stock block from which multiple building panels can be produced.

In some embodiments, multiple building panels are produced from a solid block made in one molding process. Each of the building panels may be produced by slicing the building panel from a solid larger solid block. FIG. 6 illustrates a stock block from which multiple building panels can be produced. Frames 160 may be placed in a mold in a parallel spaced relationship to one another. In some embodiments, frames 160 include studs and cross rails, such as those described above relative to FIGS. 1 and 2. Fixture elements 162 may maintain frames 160 in the desired spacing from one another during a molding process. Loose polymeric material, such as polymeric beads or pellets, may be introduced into the mold around and within frames 160. In some embodiments, the loose polymeric material includes pre-foamed polystyrene beads. The polymeric material may be heated to fuse the media. The block may be allowed to cool to form stock block 164. At this point, the frame elements are fixed in place in the stock block. Fixture elements 162 may be removed.

After stock block 164 is formed, it may be removed from the mold and positioned at a cutting station. The cutting station may include a hot wire cutting system with one or more hot wires. The hot wire system may be used to slice stock block 164 at planes 166 to create multiple block segments. Each of the segments may form a building panel 168. Each building panel 168 may include one of frames 160 and a block 170. The hot wire system may be used to perform additional shaping and cutting, such as adding notches, cavities, passages, or windows to the panel.

Figure 7:
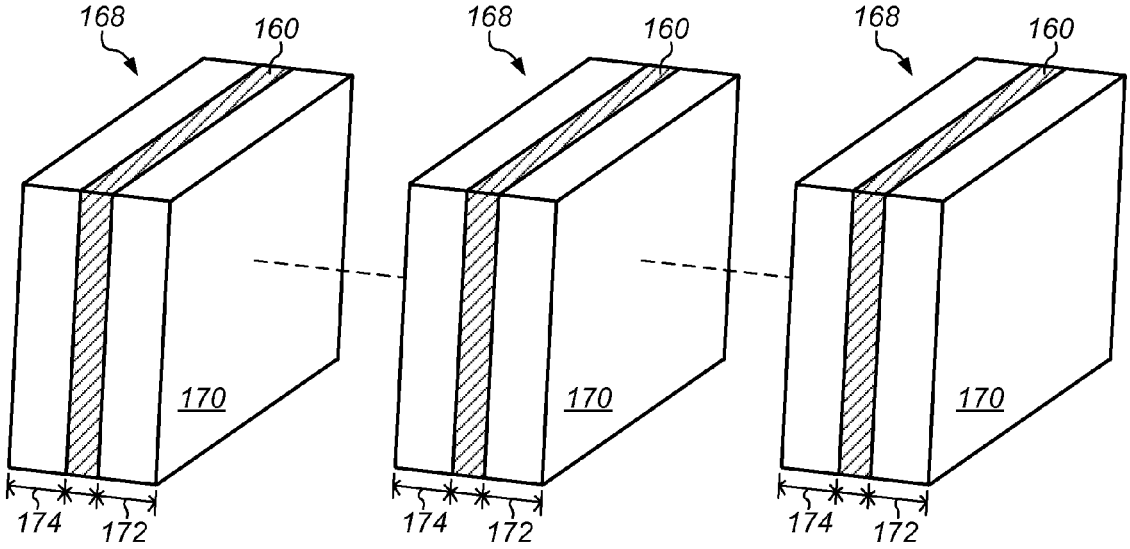
FIG. 7 illustrates building panels after separation of a stock block.

FIG. 7 illustrates building panels 168 after separation of a stock block. As illustrated in FIG. 7, each panel 168 may include offsets 172 and 174 in either direction from the frame. In one embodiment, a building panel includes a frame section 3 and ⅝ inches thick, with an offset in one direction of 3 and ⅝ inches and an offset in the other direction of 5 and ⅜ inches. In one embodiment, a building panel includes a frame section 3 and ⅝ inches thick, with an offset in one direction of 4 and ⅜ inches and no offset (offset of zero) in the other direction. In one embodiment, a building panel includes a frame section 3 and ⅝ inches thick, with an offset in one direction of 8 and ⅜ inches and no offset (offset of zero) in the other direction.

In an embodiment, a block for producing building panels includes a solid polymeric block and two or more building panel frames coupled to the solid polymeric block. The solid polymeric block may be sliced into portions (for example, segmented) to produce two or more building panels. Each of the building panels so produced may include one of the building panel frames. In some embodiments, the frames are included in the block in an array such that the block can be sliced in two more different directions to slice off rows or columns of building panels from the block. In some embodiments, the block is produced using the procedures described above relative to FIGS. 6 and 7.

In some embodiments, panels are aligned to promote flow of the polymeric material during formation of the solid block. In one embodiment, a cradle is used to align elements during formation. Holes may be provide in steel to improve flow, for example, to allow the polymeric material to reach spaces in or around doors and windows.

Steam may be used to heat the loose polymeric material. In one embodiment, the oven is heated to a temperature of about 212 degrees F. to about 220 degrees F. In one embodiment, the oven is heated to a temperature of about 200 degrees F. to about 250 degrees F. In certain embodiments, the polymeric material is heat molded. For example, the polymeric material is molded to expand against metal elements, such as frame elements. In certain embodiments, a vacuum is pulled such that the polymeric material is vacuum packed.

In some embodiments, a polymer material is selected to reduce moisture retention. In one embodiment, a block is formed from a closed cell polystyrene. The block may be allowed to cure. In one process, the block is allowed to cure for about 3 days.

Figure 8:
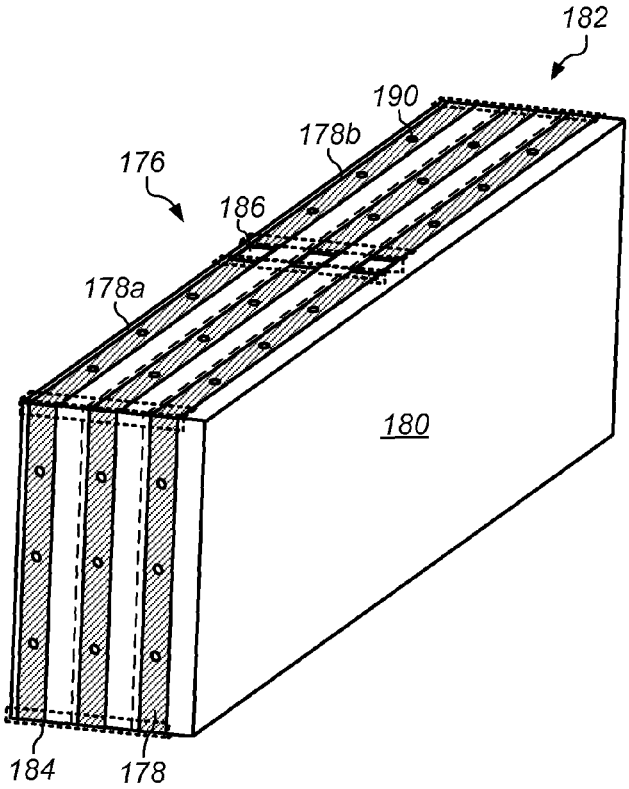
FIG. 8 illustrates one embodiment of a block from which building panels may be produced.

FIG. 8 illustrates one embodiment of a block from which building panels may be produced. Block 176 includes frames 178 and solid polymeric block 180. Each of frame 178 is partially included within block 180. Frames 178 are arranged in rows and columns in block 180. Within each row, frames 178 may be arranged in an end-to-end arrangement (As used herein, "end-to-end" does not require that the ends of adjacent items are in contact with one another.) For example, in FIG. 8, frame 178*a* is arranged in an end-to-end arrangement with frame 178*b*. Frame arranged end to end may be coupled to one another by a connector member, such as connecting member 186. Rows may be is a spaced relationship with one another by spacing rails 184.

Although in the embodiment shown in FIG. 8, the frames are arranged in 3 by 2 arrangement for illustrative purposes, any number of frames may in various embodiments be placed in array in, for example, any number of row and columns. In certain embodiments, adjacent rows or columns of frames may be staggered from one another.

In an embodiment, an assembly for producing building panels includes two or more building panel frames and one or more fixture members coupled to the building panel frames. The fixture members may maintain building panel frames in a fixed spatial relationship to one another while a solid polymeric block formed from loose polymeric materials in, near, or around the frames.

Figure 9:
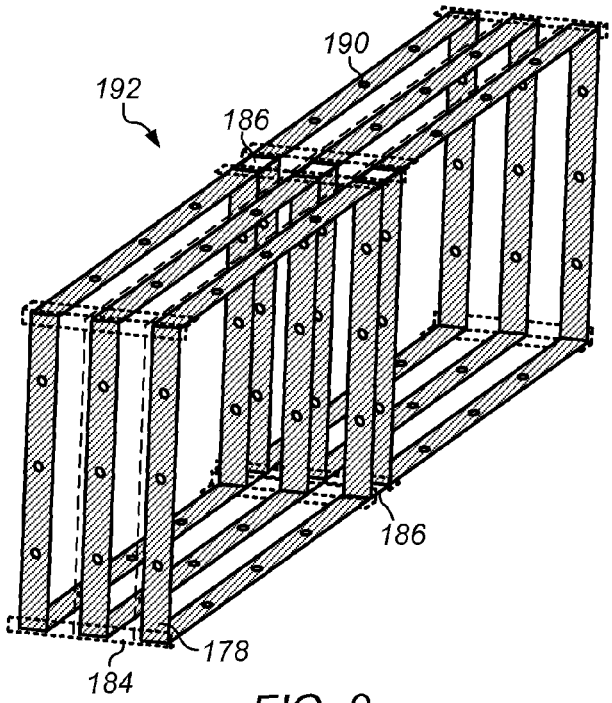
FIG. 9 illustrates one embodiment of an assembly for producing a set of building panels.

FIG. 9 illustrates one embodiment of an assembly for producing a set of building panels. The assembly may be used, for example, to produce a block from which panels can be sliced such as the block shown in FIG. 8. Assembly 192 includes frames 178 arranged in an array. Frames 178 may be connected to one another by way of fixture members. In FIG. 9, rows of frames 178 are held in a spaced relationship from one another by way of angles 184. Adjoining frames 178 within a given rows are coupled by way of connecting members 186. Angles 184 and connecting members 186 may be made of metal.

Frame members and fixture members in an assembly may include holes that allow polymeric material, steam, air, or other materials to pass through. For example, in the embodiment shown in FIG. 9, frames 178 include holes 190. Holes 190 may allow or promote loose polymeric material reach spaces within frames 178. Holes 190 may also allow or promote hot air, steam or other things used in creating solid polymeric block 180 to reach locations as part of the solid block formation process.

Figure 10:
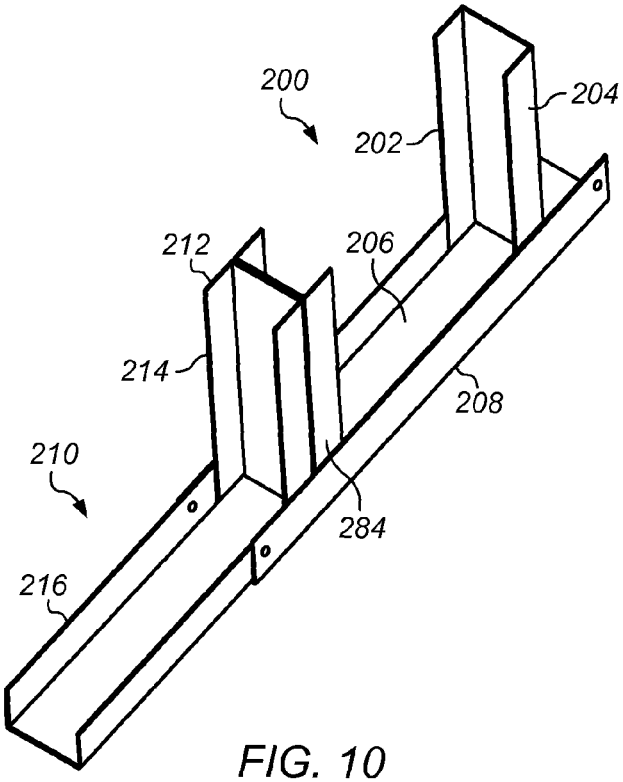
FIG. 10 illustrates one embodiment of frame members at a connection between two building panels.

In some embodiments, a building panel frame member includes an element for coupling to adjacent frame members. FIG. 10 illustrates one embodiment of frame members at a connection between two building panels (in FIG. 10, polymeric blocks are omitted for illustrative purposes.) Building panel 200 includes frame 202. Frame 202 includes studs 204 and bottom rail 206. Bottom rail 206 includes coupler channels 208. Coupler channels 208 extend laterally from either end of building panel 200.

Building panel 210 includes frame 212. Frame 212 includes studs 214 and bottom rail 216. Building panel 210 may be positioned next to building panel 200 such that bottom rail 216 is received in coupler channel 208. In some embodiments, building panel 210 is secured in coupler channel 208 by way of, for example, a pin or a bolt.

Although in the embodiment shown in FIG. 10, building panel 200 includes coupler channels at both ends of the panel, a building panel may, in various embodiments, include a coupler elements at only one end, or include no coupler elements. In certain embodiments, each building panel in a row of building panels includes a coupler channel at only one end, and one end of each successive panel is received in a coupler channel of the building panel next to it.

Figure 11:
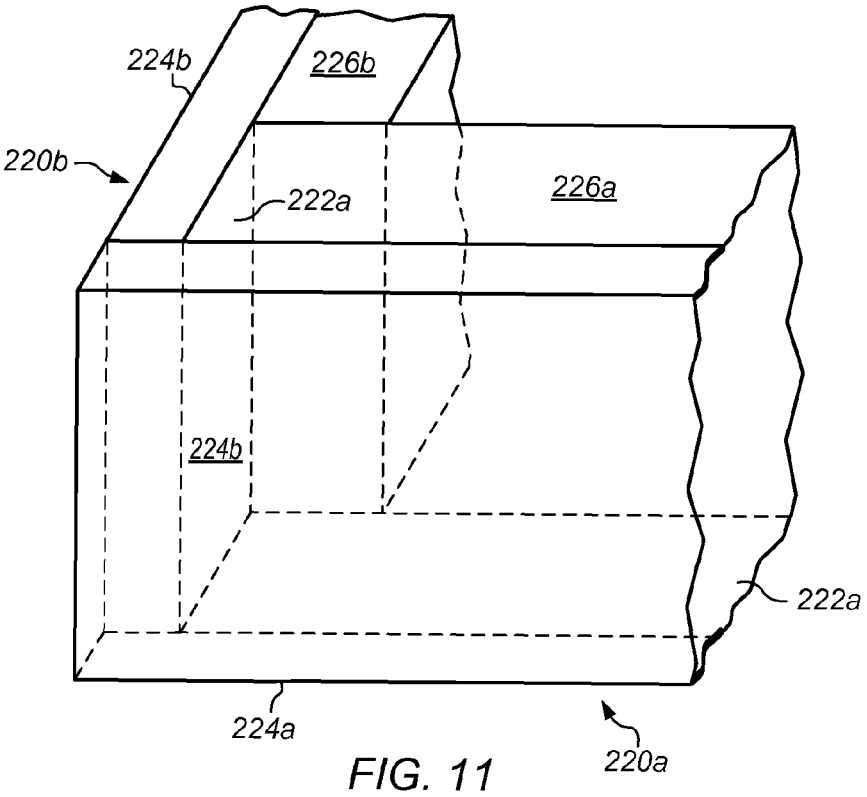
FIG. 11 illustrates one embodiment of a junction between two building panels at a corner of a building.

In some embodiments, offsets of building panels are arranged to at least partially overlap one another at a junction between two building panels. FIG. 11 illustrates one embodiment of a junction between two building panels at a corner of a building. Building panel 220*a* includes block 222*a* and frame 224*a*. Block 222*a* includes offset 226*a*. Building panel 220*b* includes block 222*b* and frame 224*b*. Block 222*b* includes offset 226*b*. Offsets 226*a* and 226*b* are notched relative to the ends of building panels 220*a* and 220*b* such that the end of offset 226*a* meets the interior side of block 222*b* and the end of offset 226*b* meets the interior side of offset 226*a*.

Figure 12:
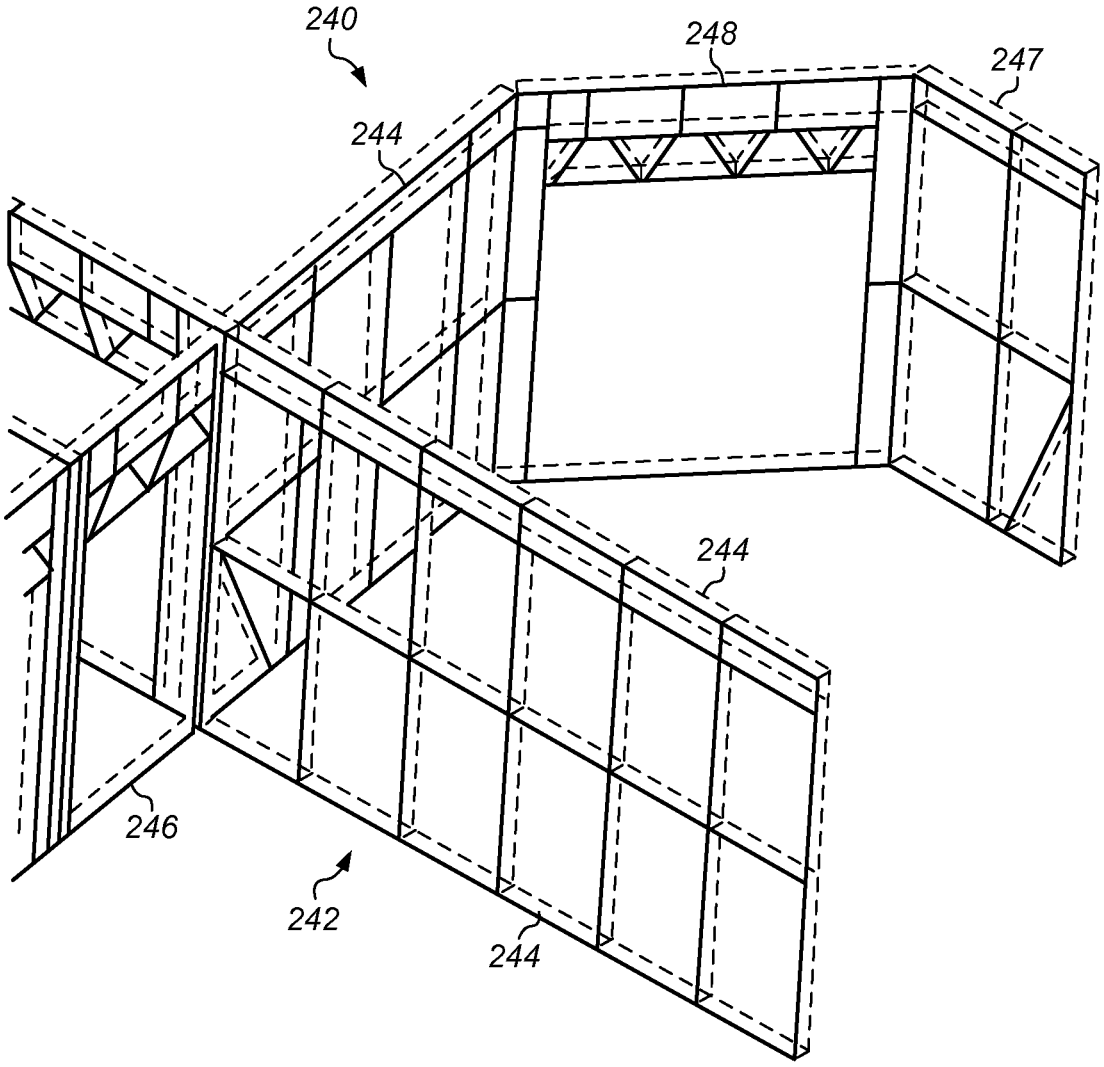
FIG. 12 illustrates one embodiment of a building constructed from building panels having a framed polymeric block construction.

FIG. 12 illustrates one embodiment of a building constructed from building panels having a framed polymeric block construction. Building 240 includes various types of building panels 242. Building panels 242 include, for example, wall panels 244, door panel 246, and window panel 248. Any or all of wall panels 244, door panel 246, and window panel 248 may include a polymeric block with a frame. Building panels 242 may be similar in construction to those described above relative to FIGS. 1 and 2. Any or all of wall panels 244, door panel 246, and window panel 248 may include block offsets from the frame of the panel. In some embodiments, one or more of the building panels for a building are cut to size and shape. Cutting of the panels may be performed on-site (for example, during construction of the building) or off-site.

Various types of siding or other exterior elements may be attached to, or placed in front of, the exterior surfaces of building panels 242. Various types of finishing elements or materials, such as drywall, may be attached to, or placed in front of, the interior surfaces of building panels 242.

In some embodiments, a building is assembled by placing two or more building panels on a surface to form a row. Building panels may be connected by any of the various approaches described above. In some embodiments, each panel is free standing when placed on the slab or other supporting element or structure. As such, in some embodiments, a building is constructed without bracing elements to hold the building panels in place during construction.

Figure 13A:
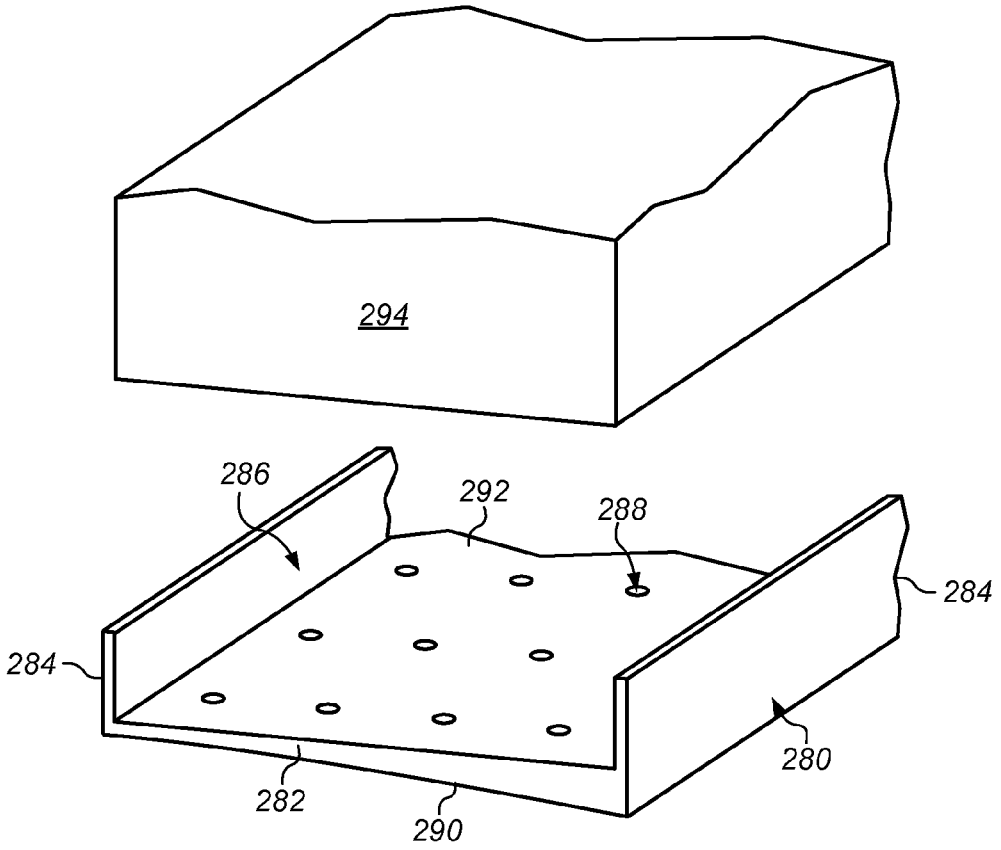
FIG. 13A illustrates one embodiment of a trough footing and a building panel that can be mounted on the trough footing.

In some embodiments, one or more building panels are installed on a footing. The footing may account for geometric variances or features of a slab or foundation. For example, a footing may compensate for curvature or a slope in a slab on which the building panel is to be mounted. In certain embodiments, a trough footing is used to level FIG. 13A illustrates one embodiment of a trough footing and a building panel that can be mounted on the trough footing. In FIG. 13A, the trough footing and building panel are shown separated from one another for illustrative purposes.

Trough footing 280 includes base 282, flanges 284, channel 286, and apertures 288. Base 282 includes bottom 290. Bottom surface 290 of base 282 may be non-parallel to top surface 292. Building panel 294 may seat in channel 286 of trough footing 280. Building panel 294 may be similar in construction to that described above relative to FIG. 1.

The size of a trough footing (for example, thickness) or shape of a trough footing (for example, curvature or slope in bottom surface 290) may compensate for deviations in the surface of a slab on which the building panels are to be mounted (for example, curvature in the top surface of a slab). In certain embodiments, a trough footing includes steps or ridges. The trough footing may be positioned on a slab such that a building panel is horizontal when installed on the slab.

In one embodiment, trough footing 280 is made of galvanized steel. Apertures 288 may allow any liquid to drain from channel 286. For example, apertures 288 may allow condensation that drips into channel 286 to drain out the bottom of base 282.

Figure 13B:
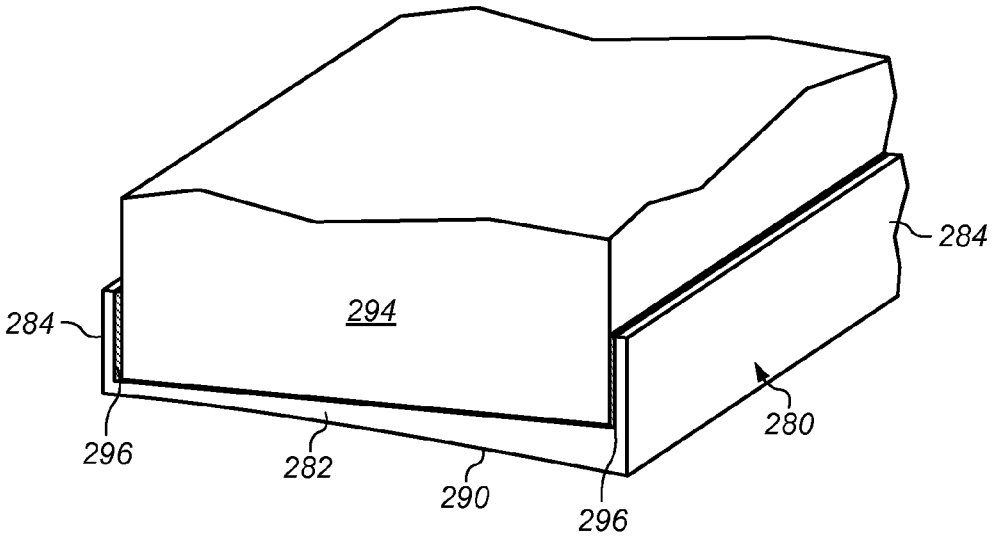
FIG. 13B illustrates one embodiment of a building panel installed in a trough.

In some embodiments, a sealant is used between elements of a building panel, or between a building panel and adjoining elements of a building. FIG. 13B illustrates one embodiment of a building panel installed in a trough. Sealant 296 may inhibit liquids from entering in the space between trough footing 280 and building panel 294. In one embodiment, sealant is sprayed on at the seams where building panel 294 and flanges 284 meet.

Figure 14:
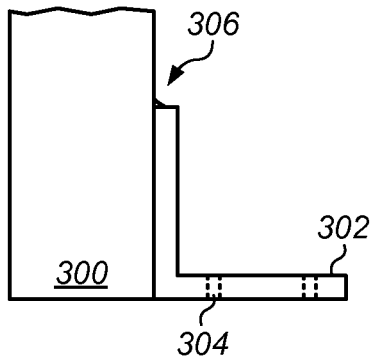
FIG. 14 is a side view illustrating one embodiment of a building panel with an exterior footing.

In some embodiments, a footing is installed at or near the base of a building panel on the interior or exterior side of the panel. FIG. 14 is a side view illustrating one embodiment of a building panel with an exterior footing. Footing 302 is installed on an the exterior side of block 300. Block 300 may be a polymeric foam. Footing 302 may be a galvanized steel angle. Footing 302 includes holes 304. Sealant 306 may be applied at the junction between footing 302 and block 300. Sealant 306 may inhibit condensation or other liquids from accumulating on footing 302.

Figure 15:
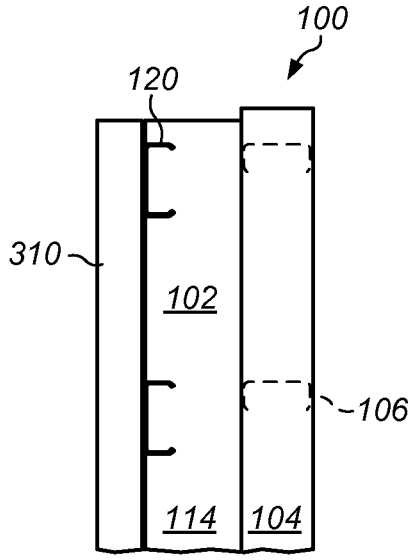
FIG. 15 is a top view illustrating a wall that includes an insulating portion between a building panel frame and interior wallboard.

In some embodiments, an insulating portion of a polymeric block in a building panel provides thermal insulation between frame members of the building panel and interior or exterior elements attached to the panel. FIG. 15 is a top view illustrating a wall that includes an insulating portion between a building panel frame and interior wallboard mounted to the building panel. In FIG. 15, offset 114 of block 102 may serve as an insulating portion between wallboard 310 and frame 104. The insulating portion may increase an R-factor of the wall.

Figure 16:
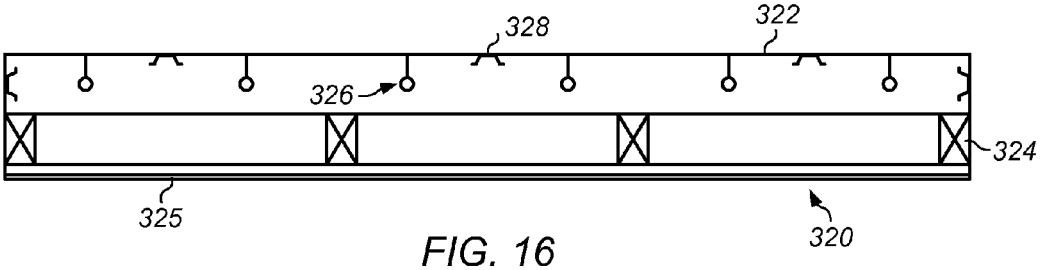
FIG. 16 is a schematic top view illustrating one embodiment of a building panel.

FIG. 16 is a schematic top view illustrating one embodiment of a building panel. Building panel 320 includes polymeric block 322 and frame 324. Vapor barrier layer 325 is coupled to the exterior surface of polymeric block 322. Polymeric block 322 includes passages 326. Passages 326 may be, for example, through holes passing from the top to the bottom of polymeric block 322. In some embodiments, exterior elements such as stucco or hardi board may be applied to the vapor barrier layer. In one embodiment, the vapor barrier layer is at least ½ inches thick.

Surfaces studs 328 are included in slots in the polymeric block 328. Surface studs may be spaced across the interior surface of polymeric block 322. In this embodiment, surface studs are provided in the interior offset portion of polymeric block 322. Studs may nevertheless be, in various embodiments, provided in other locations than the offset. For example, studs may be mounted on the exterior surface of polymeric block 322. In some embodiments, exterior elements may be coupled vapor barrier layer 325.

Figure 17:
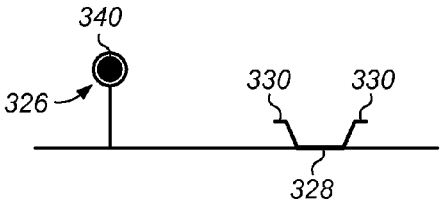
FIG. 17 illustrates a detail view of a portion of a building panel.

FIG. 17 illustrates a detail view of a portion of the building panel shown in FIG. 16. Stud 328 includes tails 330. Tails 330 may inhibit separation or movement of surface studs 328 in polymeric block 322. In some embodiments, an adhesive is provided between a stud and the polymeric block in which it is installed.

In some embodiments, electrical lines or plumbing lines are pre-installed in building panels. Building panels may be pre-installed before delivery of the panels to the site. For example, referring to FIG. 17, cable bundle 340 may be installed in passage 326

In some embodiments, windows, doors, or other apertures may be created in a building panel prior to delivery to a building site. Creating openings or apertures may reduce the time to a construct the building.

In an embodiment, a building panel includes a polymeric block, a frame coupled to the polymeric block, and a base member coupled to the polymeric block, the frame, or both. The base member couples with a slab.

In an embodiment, a method of constructing a building includes placing two or more building panels including polymeric blocks on a slab. The base of the building panels may be fastened to the slab.

In an embodiment, a building includes a slab and two or more building panels. Each of the building panels may include a polymeric block and a base. The bases of the building panels are fastened to the slab.

Figure 18:
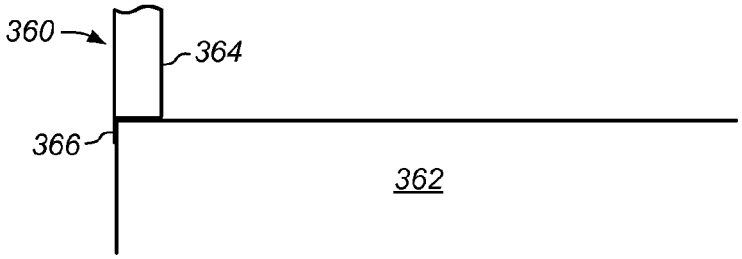
FIG. 18 illustrates one embodiment of a building panel base coupled to slab having a standard edge.

FIG. 18 illustrates one embodiment of a building panel base coupled to slab having a standard edge. Building panel 360 is installed on slab 362. Building panel 360 includes polymeric block 364 and base 366. Base 366 may be attached to slab 362. In some embodiments, a slab is floated or chipped off to prepare the slab for installation of the panels.

Figure 19:
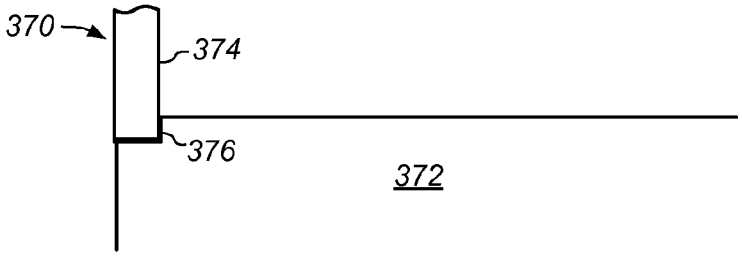
FIG. 19 illustrates one embodiment of a building panel base coupled to slab having a brick ledge.

FIG. 19 illustrates one embodiment of a building panel base coupled to slab having a brick ledge. Building panel 370 is installed on slab 372. Building panel 370 includes polymeric block 374 and base 376. Base 376 may be attached to slab 372. In certain embodiments, an 18-20 gauge sheet is provided. The sheet metal may span over voids in the slab.

Figure 20:
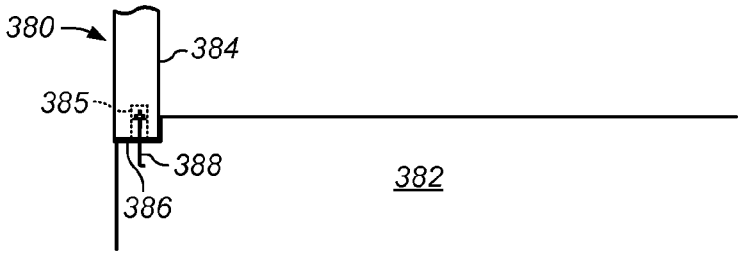
FIG. 20 illustrates one embodiment of a building panel base coupled to slab having a brick ledge by way of a threaded fastener.

FIG. 20 illustrates one embodiment of a building panel base coupled to slab having a brick ledge by way of a threaded fastener. Building panel 380 is installed on slab 382. Building panel 380 includes polymeric block 384 and base 386. Base 386 may be attached to slab 382 by way of fastener assembly 388. When building panel 380 is installed on slab 382, the threaded portion of fastener assembly 388 that extends above base 388 may be accommodated in bore 385 in polymeric block 384. In certain embodiments, holes are punched out for j-bolts/washers.

Figure 21:
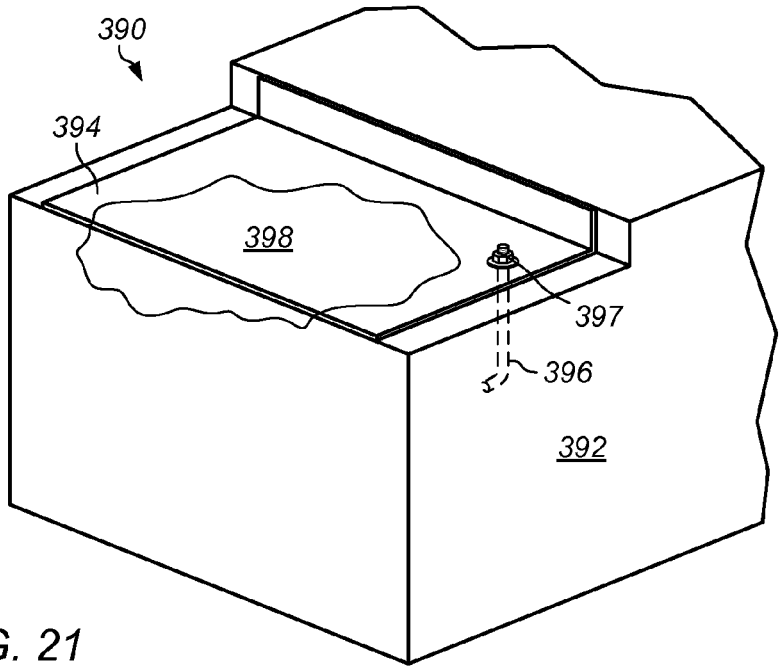
FIG. 21 illustrates a base of a building panel coupled to a slab.

FIG. 21 illustrates a base of a building panel coupled to a slab. The base may be provided, for example, on a polymeric foam panel with a frame, such as described herein. In FIG. 21, element of the building panel other than the base have been omitted for illustrative purposes. System 390 includes a base 394 of a building panel coupled to slab 392. In this example, base 394 is coupled to slab 392 by way of j-bolt 396. J-bolt 396 may be, for example, a ½ inch flat-head j-bolt. J-bolts may pass through corresponding clearance holes in base 394. In some embodiments, j-bolt fasteners are installed during slab pour. In certain embodiments, an adhesive may be used in addition to, or instead of, metal fasteners. Nut 397 may be threaded onto j-bolt 396 to attach base 394 to slab 392. Fender washers/may be provided under nut 397. In certain embodiments, a track weld washer is provided on j-bolt fasteners.

A base for a building panel may be made of any suitable material. In some embodiments, base 394 is a strip or angle of sheet metal. In certain embodiments, a base of a panel may be a strip of wood (for example, a 2 by 4).

Figure 22:
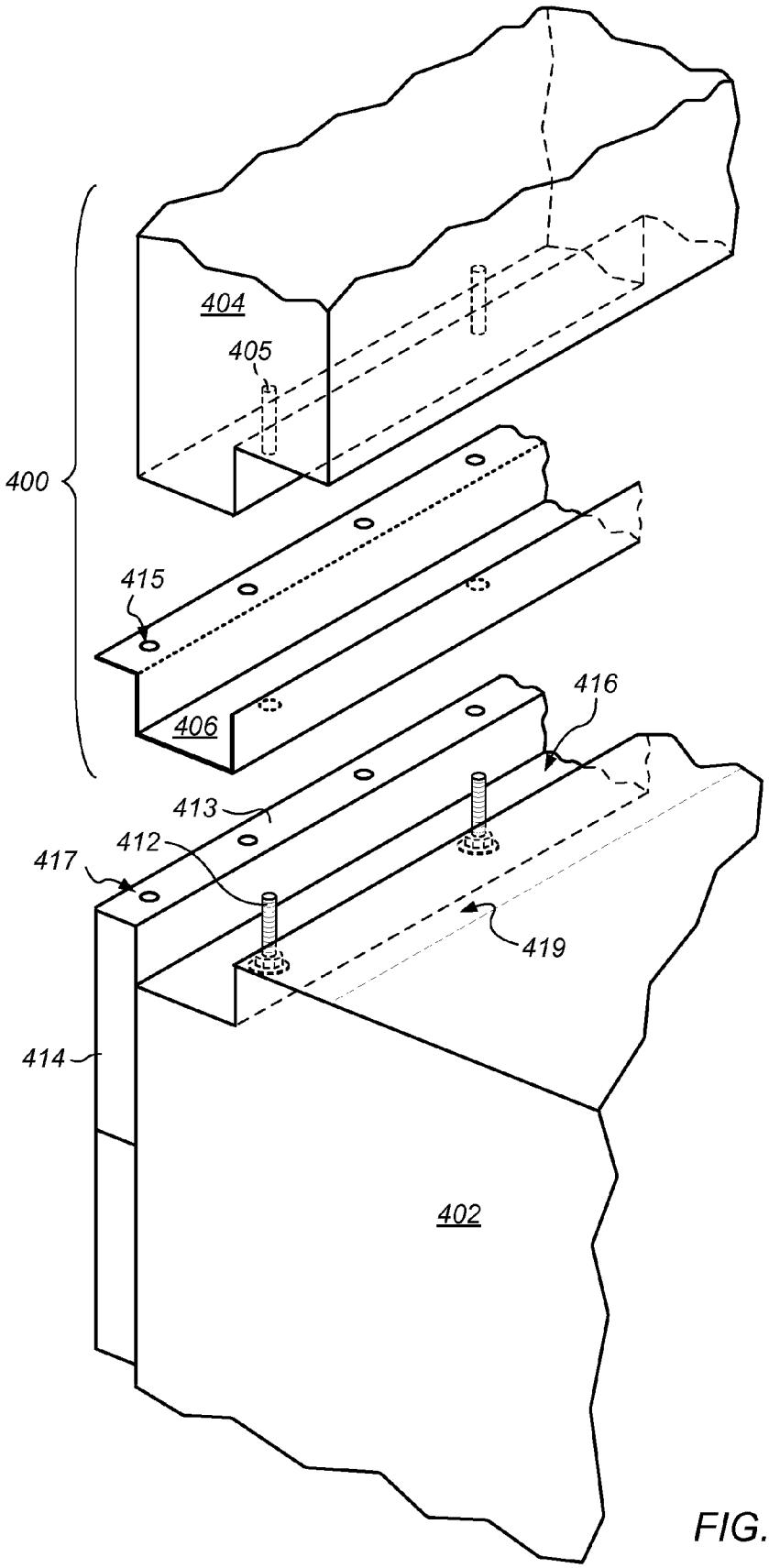
FIG. 22 is a partially exploded view illustrating one embodiment of a building panel installed on a slab with a form at its edge.

In some embodiments, a base for a building panel is mounted on a form during construction of a building. FIG. 22 is a partially exploded view illustrating one embodiment of a building panel installed on a slab with a form at its edge. Building panel 400 may be installed on slab 402. Building panel 400 includes block 404 and base 406. In some embodiments, building panel 400 includes one or more frame members. For illustrative purposes, block 404 and base 406 are shown separated from one another. During installation, however, block 404 and base 406 may be coupled to one another, for example, by an adhesive, screws, rivets, or other method. Building panel 400 may be installed in notch 416 of slab 406 so that base 406 may be secured using threaded fasteners 412. Nuts and washers may be removed and reinstalled to hold down base 406. In some embodiments, adhesive is provided between a surface of a slab and panel. For example, adhesive may be provided in area 419 of slab 402 and bond with the bottom of the interior offset portion of block 404.

In some embodiments, the outer rim 413 of base 406 comes to rest on forms 414. In certain embodiments, base 406 may be secured to the upper one of forms 414, for example, by way of screws in passed through holes 415 and threaded into holes 417 of forms 414. Forms 414 may be unfastened from base 406 and removed from slab 402. In some embodiments, rim 413 is a breakaway piece, and can be snapped off from the remaining portion of base 406.

In an embodiment, a building panel includes a solid polymeric block having an aperture, and a frame coupled in the aperture. Reinforcing elements are coupled to the frame along at least one side of the aperture. The reinforcing elements may inhibit deformation of the frame in the aperture.

In an embodiment, a method of making a building panel includes providing a frame for an aperture. At least one side of the frame is reinforced with reinforcing elements. Loose polymeric material is provided adjacent to the frame. A solid polymeric block is formed from the loose polymer material such that the frame the frame defines an aperture in the solid block. The reinforcing elements may inhibit deformation of the frame in the aperture.

Figure 23:
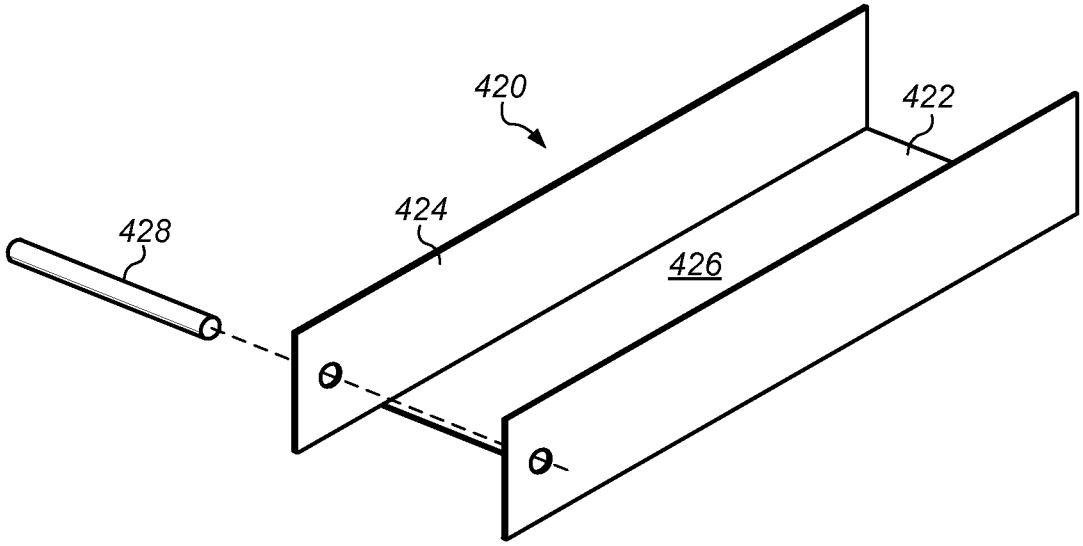
FIG. 23 illustrates one embodiment of a portion a frame member that can be reinforced with an elongated member between spaced elements of the frame member.

FIG. 23 illustrates one embodiment of a portion a frame member that can be reinforced with an elongated member between spaced elements of the frame member. Frame system 420 includes frame member 424 and reinforcing element 428. Reinforcing element may be, for example, a flat head screw.

Figure 24:
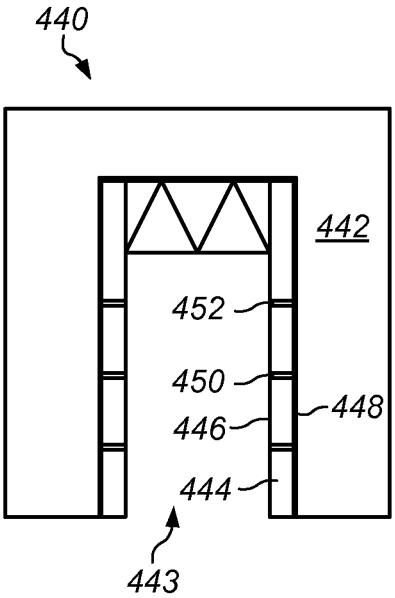
FIG. 24 illustrates one embodiment of a building panel with a framed doorway.

FIG. 24 illustrates one embodiment of a building panel with a framed doorway. Building panel 440 includes polymeric block 442 and frame 444. Frame 444 defines aperture 443. Frame 444 includes inside frame 446 and outside frame 448. Nogs 450 and 452 may span from inside frame 446 to outside frame 448. Nogs 450 and 452 may reinforce frame 444 and inhibit distortion of frame 444. Distortion may occur, for example, due to swell caused by engagement of the frame with polymeric foam. In some embodiments, some of the reinforcing elements are standard with the frame, and others are added to the frame. For example, nogs 450 may be standard, while nog 452 is added for additional stiffening of the frame. In one embodiment, 4 screws are provided per door in a building panel, and 8 screws are provided per window in a building panel. In one embodiment, one nog is added to each side of a door. In one embodiment, two nogs are added to each side of a door.

Figure 25:
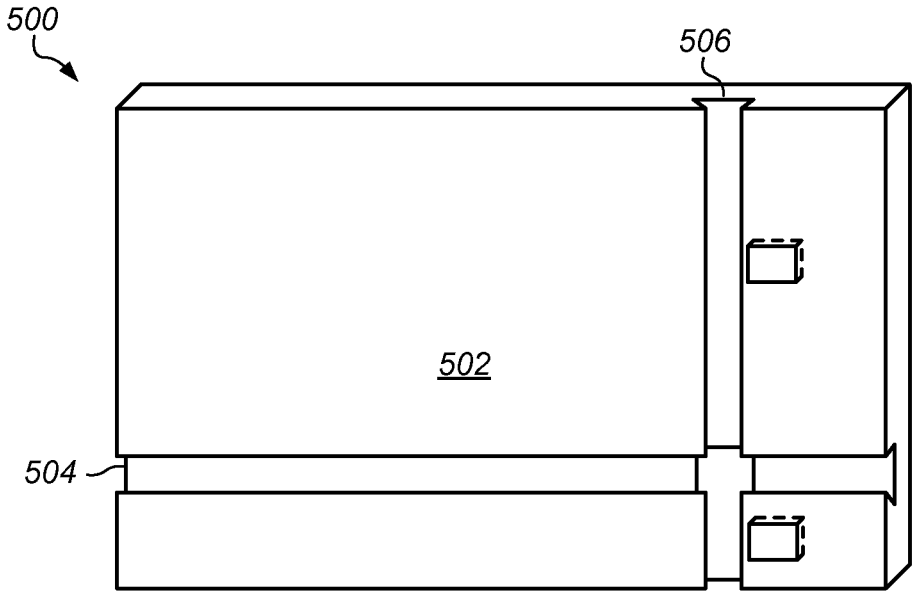
FIG. 25 illustrates an embodiment of panel that includes horizontal slots on the interior face of the panel.

In some embodiments, a panel includes slots for carrying conduit, cables, plumbing, or other elements. The horizontal slots may intersect vertical slots in the panel. FIG. 25 illustrates an embodiment of panel that includes horizontal slots on the interior face of the panel. Panel 500 includes block 502, horizontal slot 504, and vertical slot 506. Horizontal slot 504 and vertical slot 506 may intersect with one another.

Figure 26:
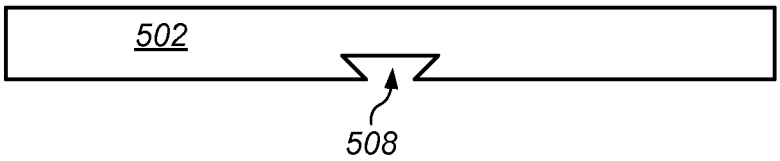
FIG. 26 illustrates one embodiment of a panel including a dovetail slot.

In some embodiments, slots for running conduits, plumbing, wires, or other elements have a dovetail cross section. For example, horizontal slot 504, vertical slot 506, or both may have dove-tail cross section 508, as shown in FIG. 26.

Figure 27:
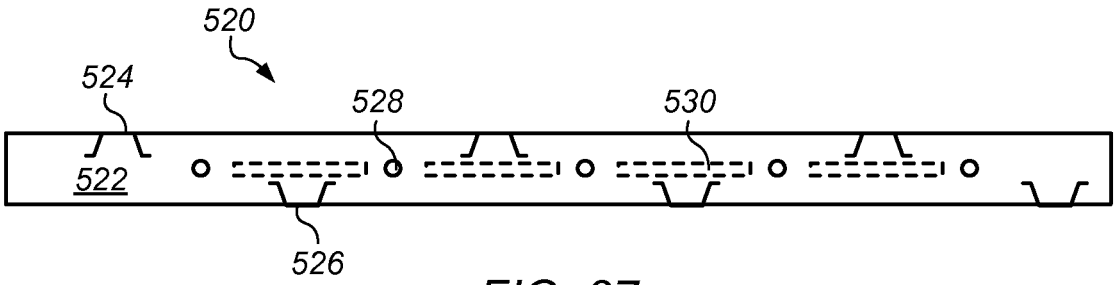
FIG. 27 is a top view illustrating one embodiment of a panel with staggered studs on opposing sides of a panel.

In some embodiments, vertical studs on opposing sides of a panel are offset from one another. In one embodiment, vertical studs on opposing sides of a panel are staggered with respect to one another. FIG. 27 is a top view illustrating one embodiment of a panel with staggered studs on opposing sides of a panel. Panel 520 includes block 522, interior studs 524, exterior studs 526, and passages 528. Interior studs 524 are offset with respect to exterior studs 526.

In certain embodiments, air cavities are provided in a panel. For example, block 502 includes pockets 530. Air cavities may be sized and shaped to provide thermal isolation, acoustic isolation, or both, between the interior and the exterior of the panel.

In some embodiments, one or both sides of a panel includes cross bracing. The ends of each of the cross bracing members by couple to junctions at the 4 corners of the panel. The crossing members may be attached to one or more additional vertical studs (for example, at the intersection of the cross members with one another. In certain embodiments, a building panel is a shear panel.

In certain embodiments, a panel includes 2⅝ inch studs. In one embodiment, a panel is about 5½ inches. Examples of other thicknesses for a panel include about 2⅜ inches, or 3½ inches.

In some embodiments described above, the cross section of a stud or other structural member is in the form of a hat section (for example, in FIG. 27). A stud or other structural member of a panel may nevertheless have any other suitable cross section. For example, a stud may have a c-shaped cross-section, a u-shaped cross-section, an arcuate cross section, a corrugated cross section, or vee-shaped cross section.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Methods may be implemented manually, in software, in hardware, or a combination thereof. The order of any method may be changed, and various elements may be added, reordered, combined, omitted, modified, etc. Changes may be made in the elements described herein without departing from the spirit and scope of the invention as described in the following claims.

What is claimed is:

1. A building panel, comprising:

a polymeric block comprising a panel interior surface and an panel exterior surface;

a frame coupled to the polymeric block, the frame comprising:

a horizontal top rail;

a horizontal bottom rail; and a plurality of framing studs coupled to and extending between the horizontal top rail and the horizontal bottom rail, wherein a width of the frame includes a widest portion of at least one of the horizontal top rail, the horizontal bottom rail, and the plurality of framing studs;

wherein the polymeric block comprises:

a framed block portion residing within the width of the frame; and an offset block portion extending laterally outside the width of the frame formed by the horizontal top rail, the horizontal bottom rail, and the plurality of framing studs, wherein the offset block portion comprises an upper surface that lies outside a width of the horizontal top rail and is not under the horizontal top rail, wherein the offset block portion comprises one or more passages at least partially in the offset block portion, wherein at least one of the one or more passages are configured to receive electric lines or plumbing lines, wherein at least one opening of the one or more passages is outside the width of the horizontal top rail and not under the horizontal top rail;

wherein the panel interior surface of the polymeric block is offset from the framing studs, wherein the panel interior surface of the polymeric block comprises one or more slots, wherein at least one of the slots is configured to receive a stud.

2. The building panel of claim 1, wherein the plurality of framing studs comprises one or more embedded framing studs, wherein the slots are configured to receive the stud in an orientation that is different from at least one of the one or more embedded framing studs.

3. The building panel of claim 1, wherein the polymeric block comprises a window opening.

4. The building panel of claim 1, wherein at least one of the passages comprises a horizontal slot on a surface of the polymeric block, wherein the horizontal slot is configured to receive one or more electrical lines or one or more plumbing lines.

5. The building panel of claim 1, wherein the polymeric block comprises one or more doorway cut-outs.

6. The building panel of claim 1, wherein one or more electrical lines preinstalled in the polymeric block.

7. The building panel of claim 1, wherein one or more plumbing lines preinstalled in the polymeric block.

8. The building panel of claim 1, further comprising one or more trough footings configured to support at least one of the panels, wherein at least one of the trough footings comprises one or more apertures configured to inhibit liquid from accumulating in at least one of the trough footings.

9. The building panel of claim 1, wherein one or more of the framing studs are embedded by expanding loose polymeric material such that the loose polymeric material forms the polymeric block with one or more framing studs at least partially embedded in or to the polymeric block.

10. The building panel of claim 9, wherein the polymeric material is expanded by heating in an oven.

11. The building panel of claim 1, further comprising one or more studs coupled in one or more of the slots on the panel interior surface of the polymeric block.

12. The building panel of claim 11, wherein at least one of the studs coupled in the one or more slots comprises:

a substantially c-shaped cross section or substantially u-shaped cross section; and outwardly-extending tails configured to inhibit separation of the stud from the polymeric block.

13. A building panel, comprising:

one or more polymeric blocks;

a frame comprising:

a horizontal top rail;

a horizontal bottom rail; and a plurality of framing studs coupled to and extending between the horizontal top rail and the horizontal bottom rail, wherein a width of the frame is a widest portion of the horizontal top rail, the horizontal bottom rail, and the plurality of framing studs;

wherein at least one of the framing studs is at least partially embedded in or to at least one of the one or more polymeric blocks;

wherein at least one of the one or more polymeric blocks comprises:

a framed block portion residing within the width of the frame; and an offset block portion extending laterally outside the width of the frame formed by the horizontal top rail, the horizontal bottom rail, and the plurality of framing studs, wherein the offset block portion comprises an upper surface that lies outside the width of the horizontal top rail and is not under the horizontal top rail, wherein the offset block portion comprises one or more passages at least partially in the offset block portion, wherein at least one of the one or more passages are configured to receive electric lines or plumbing lines, wherein at least one opening of the one or more passages is outside a width of the horizontal top rail and not under the horizontal top rail; and one or more surface-mounted framing studs mounted on at least one exterior surface of the at least one polymeric block, wherein the orientation of at least one of the surface-mounted framing studs is different from the orientation of at least one of the one or more embedded framing studs.

14. The building panel of claim 13, wherein at least one face of at least one of the polymeric blocks is offset from the framing studs.

15. The building panel of claim 13, wherein at least one of the surface-mounted framing studs is installed in an offset face of the at least one block.

16. The building panel of claim 13, wherein at least one of the polymeric blocks is sliced from a larger block of polymeric material.

17. The building panel of claim 13, wherein at least one of the polymeric blocks is sliced from a larger block of polymeric material while the one or more framing studs are in the polymeric block.

18. A building, comprising:

a plurality of building panels coupled to one another, wherein each of at least two of the building panels comprises:

a polymeric block comprising a panel interior surface and an panel exterior surface;

a frame coupled to the polymeric block, the frame comprising:

a horizontal top rail;

a horizontal bottom rail; and a plurality of framing studs coupled to and extending between the horizontal top rail and the horizontal bottom rail, wherein a width of the frame is a widest portion of the horizontal top rail, the horizontal bottom rail, and the plurality of framing studs;

wherein the polymeric block comprises:

a framed block portion residing within the width of the frame; and an offset block portion extending laterally outside the width of the frame formed by the horizontal top rail, the horizontal bottom rail, and the plurality of framing studs, wherein the offset block portion comprises an upper surface that lies outside a width of the horizontal top rail and is not under the horizontal top rail, and wherein the offset block portion comprises one or more passages at least partially in the offset block portion, wherein at least one of the one or more passages are configured to receive electric lines or plumbing lines, wherein at least one opening of the one or more passages is outside the width of the horizontal top rail and not under the horizontal top rail.

19. The building of claim 18, wherein the offset block portions of the polymeric blocks of the building panels face the interior of the building.

20. The building panel of claim 18, further comprising one or more panel connectors, wherein at least one of the connectors is configured to couple the horizontal top rail of at least one of the building panels to the horizontal top rail of at least one other of the building panels.

* * * * *